United States Patent [19]

Hughes

[11] 3,986,365

[45] Oct. 19, 1976

[54] SOIL SEALING METHOD

[75] Inventor: John Hughes, Glenview, Ill.

[73] Assignee: American Colloid Company, Skokie, Ill.

[22] Filed: Jan. 19, 1976

[21] Appl. No.: 650,241

Related U.S. Application Data

[63] Continuation of Ser. No. 551,245, Feb. 20, 1975, abandoned, and a continuation of Ser. No. 441,121, Feb. 11, 1974, abandoned.

[52] U.S. Cl. ..... 61/36 C; 61/1 R; 106/287 SS

[51] Int. Cl.[2] ..... E02D 19/16

[58] Field of Search ..... 61/1 R, 36 C, 35; 166/294, 295; 106/287 SS; 260/DIG. 14

[56] References Cited

UNITED STATES PATENTS

| | | | |
|---|---|---|---|
| 3,016,713 | 1/1962 | Deming | 61/1 R |
| 3,772,893 | 11/1973 | Eilers | 61/36 C |
| 3,789,613 | 2/1974 | Routson | 61/36 C |

*Primary Examiner*—Paul R. Gilliam
*Assistant Examiner*—Alex Grosz
*Attorney, Agent, or Firm*—Poms, Smith, Lande & Glenny

[57] ABSTRACT

There is disclosed a composition which is useful, when added to soil, in containing water, said composition containing bentonite and a particular type of water-soluble polymer, the purpose of the water-soluble polymer being to decrease the amount of bentonite necessary to form a water containing enclosure made of soil. The amount of bentonite necessary in the present invention is at least 50% and, most often, 60% less than is necessary when no water-soluble polymer is present. The water-soluble polymer is preferably polyacrylic acid, water-soluble salts of polyacrylic acid, polymethacrylic acid, water-soluble salts thereof, and acylic copolymers formed from either acrylic acid or methacrylic acid. The invention also includes a method for containing water which includes admixing an effective amount of bentonite and water-soluble polymer with soil and forming a water-containing enclosure from said mixture.

1 Claim, No Drawings

SOIL SEALING METHOD

This application is a continuation of Ser. No. 551,245, filed Feb. 20, 1975 and now abandoned and is a continuation of Ser. No. 441,121, filed Feb. 11, 1974 and now abandoned.

BACKGROUND OF THE INVENTION

Since time immemorial, the problem of containing water has faced mankind but, in recent years, this problem has been increasing as the need for water holding areas has risen faster than populations and is now a problem facing all nations of the world. In general, this increasing need for water holding areas has been due to the problems of water pollution (and what to do with the contaminated water), the need for ever increasing food and thus the need for constructing water holding areas to supply water to arid areas so that said areas are capable of growing food, and the problem of constructing dams to hold flood waters as well as constructing hydroelectric plants.

For the most part, such problems would not exist if soil itself could be utilized to form the water holding areas; however, most soils are too porous to adequately serve this purpose because of the seepage of water from such water holding areas. It has heretofore been purposed to utilize bentonite in conjunction with soil to prevent seepage of water contained in such water holding areas. The reason for utilizing bentonite is because it swells when in contact with water thereby filling up or blocking the voids found in soil. Thus, bentonite has been partially satisfactory as a solution to forming water holding areas.

However, because bentonite is relatively expensive and because a significant amount is necessary under ordinary circumstances to produce a satisfactory water holding area, bentonite has not been as extensively utilized as it might be. The expense of bentonite is particularly important in view of the rapid increase in the necessity for building water holding areas.

SUMMARY OF THE INVENTION

This invention is predicated on the surprising discovery that when a water-soluble polymer is added to bentonite, in certain amounts, the resulting composition when added to soil requires 50% to 60% less bentonite in order to prevent seepage of water therethrough then when bentonite is added to soid and no water-soluble polymer is added therewith.

Accordingly, one of the principal objects of the present invention is to disclose and provide a method for forming lagoons, irrigation ditches, and other water holding areas which will not allow seepage therethrough of water, by adding bentonite thereto, the amount of bentonite added being substantially less than is normally utilized.

Another object of the present invention is to disclose and provide a composition containing bentonite, which when added to soil to prevent seepage through the soil of water, requires 60% less bentonite than normal.

A further object of the present invention is to disclose and provide a soil which is useful in forming lagoons, irrigation ditches, dams and other water holding areas, said soil containing 60% less bentonite than is normally necessary to form water holding areas which will not allow seepage therethrough of water.

Still another object of the present invention is to disclose and provide a soil sealant composition containing bentonite and a certain type of water-soluble polymer.

Still another and further object of the present invention is to disclose a method which provides an inexpensive way of forming water holding areas utilizing bentonite and soil.

Other objects of the present invention will be apparent from the following detailed description in which all parts and percentages are by weight unless specifically indicated otherwise.

DESCRIPTION OF THE PREFERRED EMBODIMENT

As has been noted above, the invention herein specifically relates to a method for forming water holding areas utilizing bentonite, the amount of bentonite necessary to form such water holding areas being 50% to 60% less than the amount of bentonite normally necessary to form such water holding areas.

The present invention is useful for forming water holding areas by utilizing bentonite and any type of "soil", this term including sand, clay, topsoil, etc. It is of no moment what type of soil is utilized in the present invention since the composition herein will allow the utilization of at least 50% less bentonite than is normally necessary to have the bentonite swell and fill the voids contained in most soil (e.g. silica sand of large particle size). It is of course, understood, that the amount of bentonite necessary to prevent seepage of soil will vary depending upon the type of soil utilized. For example, if a very porous soil is utilized, e.g. silica sand of large particle size, more bentonite is required than if a clayey soil is used. However, regardless of the type of soil, the amount of bentonite necessary to form an adequate water holding area is still 60% less than would be required without utilizing the water-soluble polymers of the present invention.

The bentonite utilized in the present invention is one which will hydrate in the presence of water, i.e., will swell in the presence of water. A preferred bentonite is sodium bentonite which is basically a hydratable montmorillonite clay which has sodium as its predominate exchangeable ion. However, the bentonite useful in forming water holding areas in accordance with the present invention may also contain other cations such as calcium, magnesium and iron. The particular cation or cations contained in the bentonite is not important; what is important is the replaceable or exchangeable ion. As noted, sodium bentonite is a hydratable clay which has a higher degree of swelling than other bentonite clays and is therefore the type of bentonite which I prefer to utilize in this invention.

The preferred water-soluble polymer of the present invention is polyacrylic acid. As is known in the art, the salts of polyacrylic acid can be polymerized directly from the salts of acrylic acid. If desired, the salt of polyacrylic acid can be acidified to give polyacrylic acid. Additionally, polyacrylics can be made by the hydrolysis of polyacrylamide. In this invention, polyacrylic acid can be utilized per se or, more preferably, the water-soluble salts thereof, however made.

Other water-soluble polymers which may be utilized in the present invention are polymethacrylic acid and the water-soluble salts thereof as well as copolymers of the foregoing can be utilized particularly the copolymers of acrylic acid and maleic anhydride. Additionally, copolymers of maleic anhydride and vinyl acetate or vinyl alcohol may also be utilized to good effect.

It is preferred if the above polymers have a molecular weight of at least about 100,000 and preferably 150,000 or more. The preferred molecular weight of the water-soluble polymers of the present invention is between 500,000 and 2,000,000 or even more.

The amount of water-soluble polymer is relatively important if a significantly reduced amount of bentonite is used to form an adequate water holding enclosure. The amount of water-soluble polymer, based on the combined weight of the bentonite and water-soluble polymer is from 0.05% to 2.0%.

The bentonite and water-soluble polymer composition of the present invention is made very easily be merely dry mixing the bentonite and the water-soluble polymer to form a dry, granular or powder like composition. This dry granular composition can be easily introduced into any type of soil by merely dry mixing the soil and bentonite-water-soluble polymer mixture.

In order to show the unexpected results of the composition and method of this invention, a silica sand was utilized having 30% voids and to the silica sand was added 1.2 pounds of a sodium bentonite-sodium polyacrylate composition, per square foot of sand having a two-inch depth. The amount of sodium polyacrylate in said composition was 4 parts by weight and the amount of sodium bentonite was 2,000 parts by weight. There was formed a homogeneous admixture of sand, bentonite and sodium polyacrylate. The permeability of the thus formed composition was tested with water and it was found that the soil composition had no significant water leakage even after 2 weeks. In contrast thereto, when sodium bentonite alone was added to the same silica sand, 3.0 pounds of bentonite was necessary to seal the soil to the same extent as the sodium bentonite-sodium polyacrylate mixture.

In place of the sodium polyacrylate utilized in the above example, any type of water-soluble polyacrylate could be utilized as well as water-soluble salts of polymethacrylic acid such as sodium polymethacrylic.

As noted above, the particular amount of bentonite-water-soluble polymer composition added to the soil will vary depending upon the porosity of the soil; however, very good results have been obtained utilizing anywhere from 1 to 10 pounds per cubic foot of soil.

In the foregoing exemplary embodiment certain compounds and polymers were utilized and certain percentages; however other polymers and soil can be utilized to equally good effect and in varying amounts, it being understood that the exemplary embodiments illustrated above are for illustration purposes only and are not to be considered limiting.

I claim:

1. A method of containing water in an effective water holding area formed of a soil-bentonite admixture comprising the steps of: determining a quantity of bentonite which, when admixed with a quantity of soil, forms a bentonite-soil admixture having an effective water holding capacity; admixing not more than 50 percent of said quantity of bentonite with said amount of soil to form a soil-bentonite admixture; providing in said soil-bentonite admixture a water soluble polymer in an amount of from 0.05 to 2.0 percent, based on the weight of the bentonite and polymer, said soluble polymer being selected from the group consisting of polyacrylic acid and water soluble salts of polyacrylic acid, to provide a soil-bentonite-polymer admixture; said quantity of polymer being sufficient that the water holding capacity of said soil-bentonite-polymer admixture is at least as high as said effective water holding capacity of a soil-bentonite admixture containing said determined quantity of bentonite; forming a water holding area from said soil-bentonite-polymer admixture; and providing water in said water holding area.

* * * * *